US012723361B2

(12) United States Patent
Carter et al.

(10) Patent No.: US 12,723,361 B2
(45) Date of Patent: Sep. 1, 2026

(54) DIVERSION POINT WATER DELIVERY CONTROL SYSTEM

(71) Applicant: CJC Holdings, LLC, Logan, UT (US)

(72) Inventors: Clayton Reed Carter, North Logan, UT (US); E. Clay Slade, North Logan, UT (US); Janos Lakatos, Mendon, UT (US); Koby John Hale, Burley, ID (US); Nathan Gibbons Merrill, Logan, UT (US)

(73) Assignee: CJC Holdings, LLC, Logan, UT (US)

( * ) Notice: Subject to any disclaimer, the term of this patent is extended or adjusted under 35 U.S.C. 154(b) by 178 days.

(21) Appl. No.: 18/767,904

(22) Filed: Jul. 9, 2024

(65) Prior Publication Data

US 2024/0401293 A1 Dec. 5, 2024

Related U.S. Application Data

(63) Continuation-in-part of application No. 17/951,042, filed on Sep. 22, 2022, now Pat. No. 12,178,167.
(Continued)

(51) Int. Cl.
*E02B 7/20* (2006.01)
*E02B 7/28* (2006.01)

(52) U.S. Cl.
CPC ..... *E02B 7/205* (2013.01); *E02B 7/28* (2013.01)

(58) Field of Classification Search
CPC ... E02B 7/205; E02B 7/26; E02B 7/28; E02B 7/36; E02B 13/00; E02B 13/02
See application file for complete search history.

(56) References Cited

U.S. PATENT DOCUMENTS 3,952,522 A * 4/1976 Shettel ..... E02B 13/02 405/96
4,464,079 A * 8/1984 Chance ..... E02B 13/00 405/36
(Continued)

FOREIGN PATENT DOCUMENTS

CN 110616683 A * 12/2019 ..... E02B 7/26
CN 111649151 A * 9/2020 ..... F16K 37/005
(Continued)

OTHER PUBLICATIONS

Arachchige et al., An Automatic Control System for Sluice Gate in Salinity and Flood Control in Open Canal, Sep. 24, 2017, Symposium on Transport Phenomena, Apr. 13, 2021; Sri Lanka.

*Primary Examiner* — Amber R Anderson
(74) *Attorney, Agent, or Firm* — Preston P. Frischknecht; Project CIP

(57) ABSTRACT

A diversion point water delivery control system with a headgate assembly, first gate, and powered actuator for controlling the first gate. A headgate box surrounds the headgate assembly and has a second gate that restricts waterflow to the diversion point. Sensors measure water levels adjacent to the headgate box and determine water flow. A powered control unit connects to the powered actuator and sensors and has a computer with memory to operate the system, as well as a transceiver for sending and receiving instructions and data. In one mode of operation, the first gate may be automatically positioned and repositioned to maintain a predetermined water flow through a diversion to a channeled waterway despite water level fluctuations in a primary waterway from which water is diverted. This helps the system conserve water by preventing overdelivery and over-diversion in water delivery networks.

18 Claims, 14 Drawing Sheets

Related U.S. Application Data

(60) Provisional application No. 63/526,006, filed on Jul. 11, 2023.

(56) References Cited

U.S. PATENT DOCUMENTS

| | | | | | |
|---|---|---|---|---|---|
| 4,498,809 | A * | 2/1985 | Farmer | G05D 9/12 | 405/37 |
| 4,832,527 | A * | 5/1989 | Bachmann | E02B 7/28 | 405/105 |
| 6,427,718 | B1 | 8/2002 | Stringam et al. | | |
| 8,292,542 | B2 * | 10/2012 | Aughton | E02B 7/28 | 405/87 |
| 8,602,686 | B2 | 12/2013 | Aughton et al. | | |
| 8,608,404 | B2 * | 12/2013 | Safreno | A01G 25/16 | 405/92 |
| 9,500,476 | B2 * | 11/2016 | Mikesell | F16H 25/2015 | |
| 9,537,183 | B2 * | 1/2017 | Appelboom | H01M 10/465 | |
| 9,759,591 | B2 | 9/2017 | Pearson et al. | | |
| 10,039,242 | B1 * | 8/2018 | Goldwasser | H02S 99/00 | |
| 10,053,829 | B2 * | 8/2018 | Watson | E03F 5/107 | |
| 10,458,085 | B2 | 10/2019 | Appelboom et al. | | |
| 12,084,826 | B2 * | 9/2024 | Aughton | E02B 7/28 | |
| 2002/0066484 | A1 * | 6/2002 | Stringam | E02B 13/02 | 137/392 |
| 2012/0275863 | A1 * | 11/2012 | Goldwasser | E02B 7/28 | 405/103 |

FOREIGN PATENT DOCUMENTS

| | | | | | |
|---|---|---|---|---|---|
| CN | 110017874 | B | | 11/2020 | |
| CN | 111926782 | A | * | 11/2020 | E02B 7/26 |
| CN | 114182697 | A | * | 3/2022 | E02B 7/54 |
| KR | 200359186 | Y1 | * | 8/2004 | E02B 7/54 |
| KR | 20090129127 | A | * | 12/2009 | E02B 13/02 |
| KR | 20100037393 | A | * | 4/2010 | E02B 13/02 |
| KR | 20100096450 | A | * | 9/2010 | E02B 7/26 |
| KR | 200453775 | Y1 | | 5/2011 | |
| KR | 101113070 | B1 | | 2/2012 | |
| KR | 20140058740 | A | * | 5/2014 | E02B 7/28 |
| KR | 20150027537 | A | * | 3/2015 | E02B 13/00 |
| KR | 20160004033 | A | * | 1/2016 | E02B 13/02 |
| KR | 20170000599 | A | * | 1/2017 | E02B 7/20 |
| KR | 20180005560 | A | * | 1/2018 | H02S 40/38 |
| KR | 102184531 | B1 | | 11/2020 | |
| KR | 102377616 | B1 | | 3/2022 | |

* cited by examiner

DIVERSION POINT WATER DELIVERY CONTROL SYSTEM

RELATED APPLICATIONS

This application contains aspects of and is related to U.S. patent application Ser. No. 17/951,042, filed on Sep. 22, 2022, with a priority date of Sep. 23, 2021, and is the non-provisional version of U.S. Pat. App. No. 63/526,006, with a priority date of Jul. 11, 2023, each of which is incorporated herein.

BACKGROUND

A number of problems are presented at points of diversion (headgates off of canals for example) within water delivery systems. High flow variability in primary channels can cause issues in secondary channels ranging from delivery to users beyond their allocation to variable delivery to dangerous flooding events. This can be an acute problem in the arid-West where water levels in a canal may fluctuate two feet or more during a single day in the irrigation season. More generally, many irrigation systems do not provide meaningful flow and diversion data to optimize function and efficiency. What is needed is a scalable system that can set a target flowrate at a point of diversion, such as a headgate at a canal, and allow a user to control and monitor flowrate through that point of diversion even though upstream delivery sources fluctuate, at times in the extreme.

SUMMARY OF THE INVENTION

In accordance with the above, a new diversion point water delivery control system is provided. The system is configured to deliver a target flowrate downstream despite variable upstream water levels by incorporating: a headgate box with a gate configured to slidably open and close an aperture between a canal and adjacent diversion point; a headgate assembly for opening and closing the gate; a first sensor located outside the headgate box; a second sensor located inside the headgate box; and a powered control unit in communication with the sensors and headgate assembly.

BRIEF DESCRIPTION OF THE FIGURES

To further clarify the above and other aspects of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The drawings may not be drawn to scale. The invention will be described and explained with additional specificity and detail through the use of the accompanying drawings in which.

DETAILED DESCRIPTION OF THE ILLUSTRATED EMBODIMENT

Figure 1:
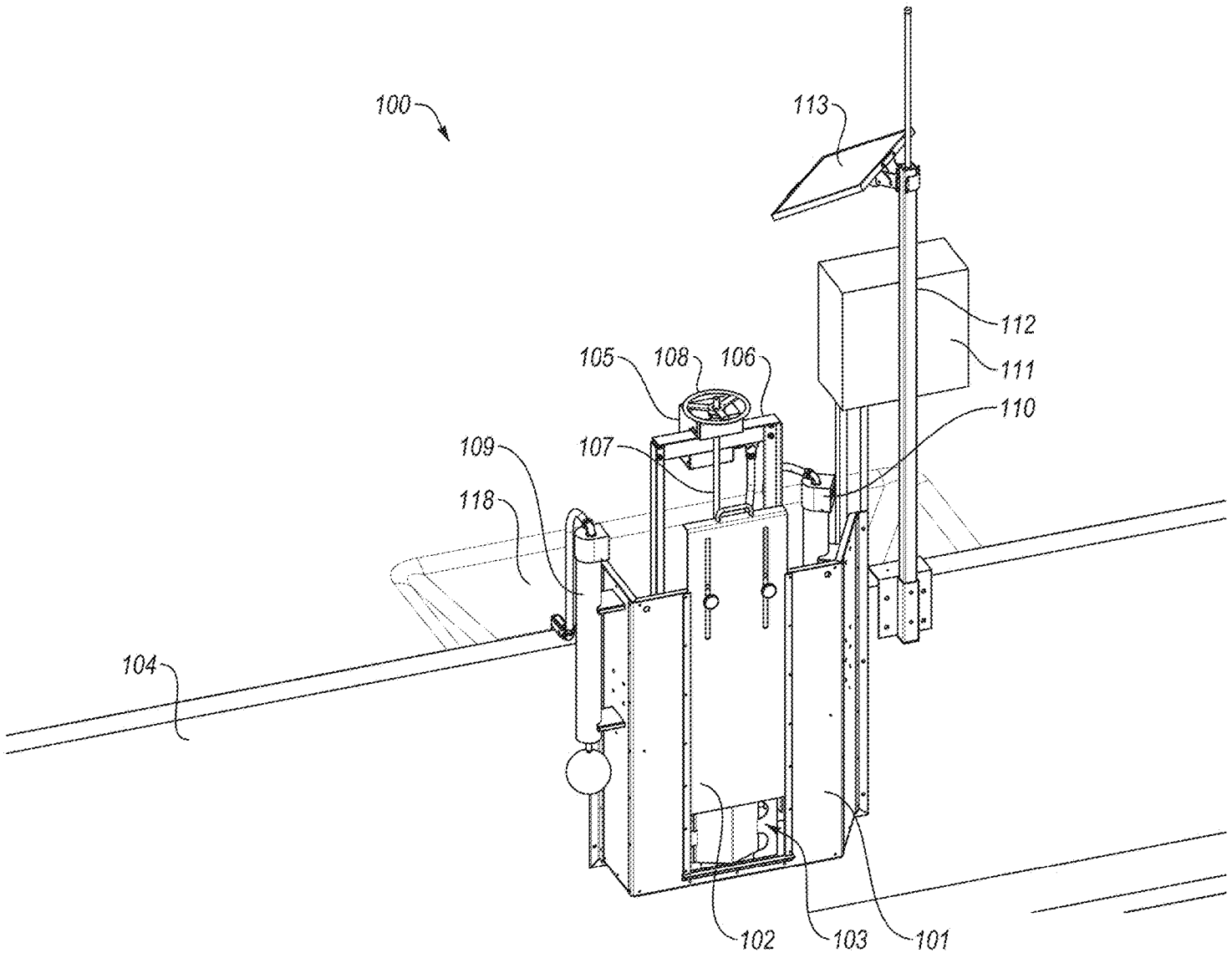
FIG. 1 is a first front perspective view of a first embodiment of a diversion point water delivery control system in a canal environment.
Figure 2:
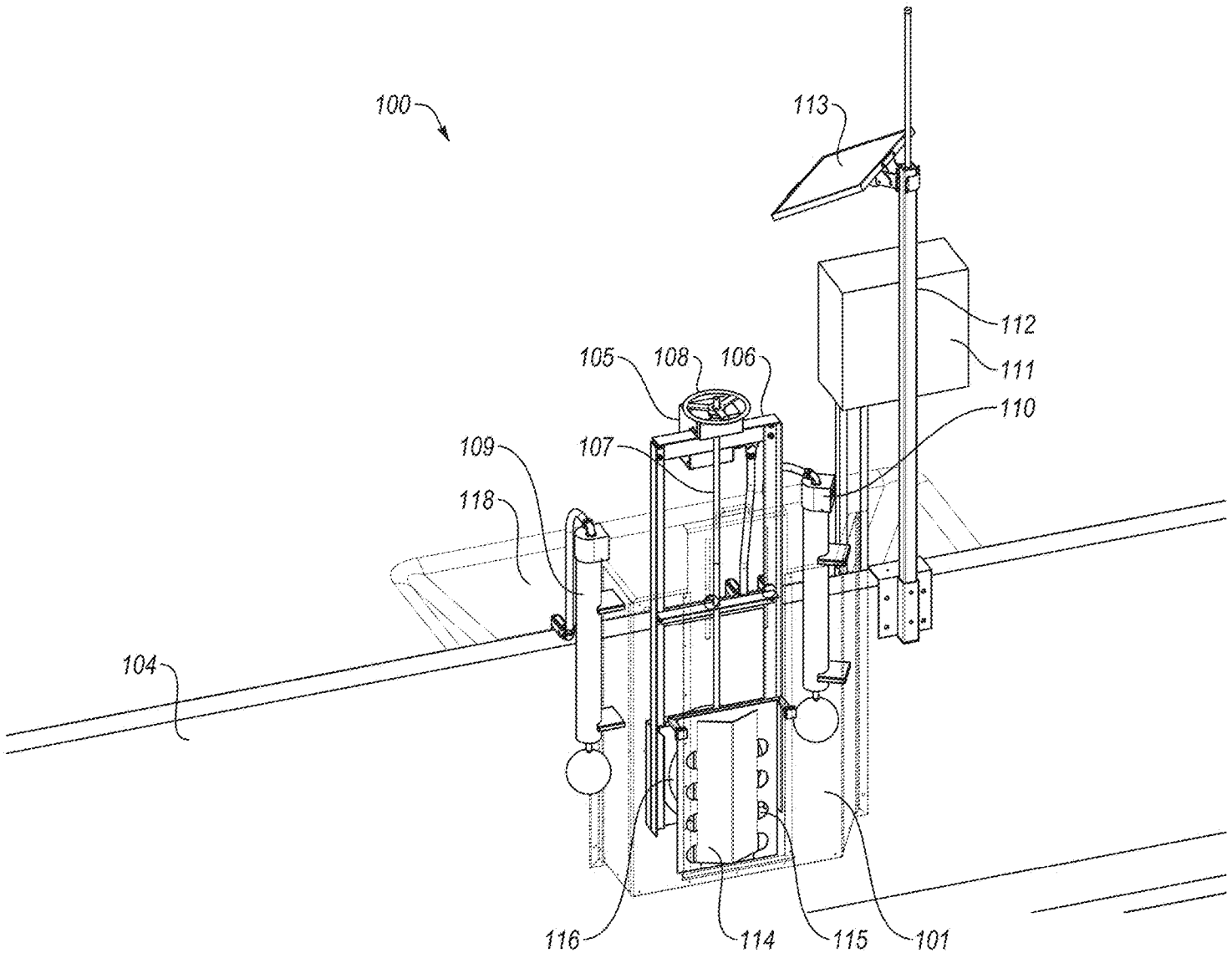
FIG. 2 is a second front, partial cross-section perspective view of a first embodiment of a diversion point water delivery control system in a canal environment.
Figure 3:
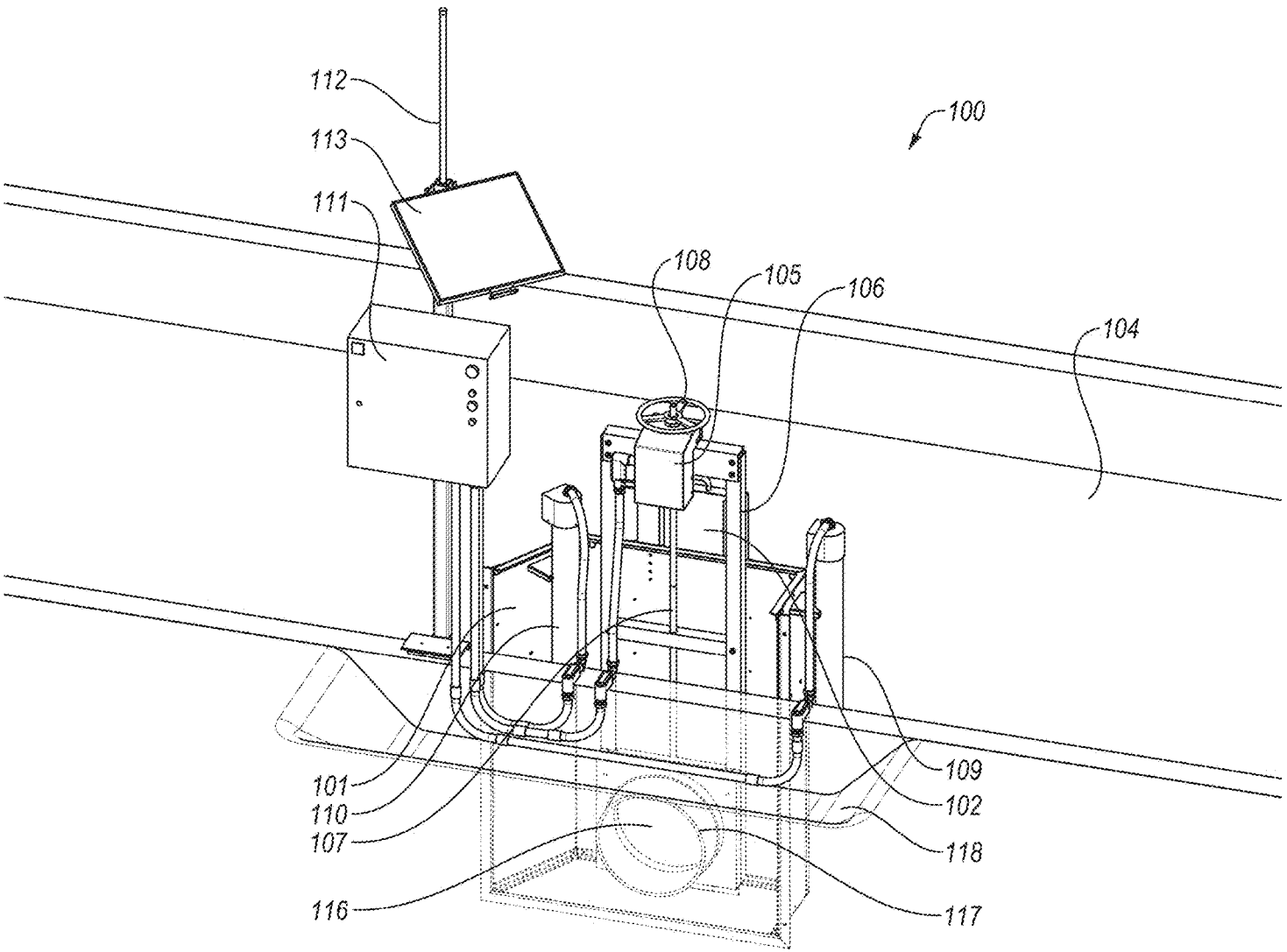
FIG. 3 is a back perspective view portion of a first embodiment of a diversion point water delivery control system.

The present invention in its various embodiments, some of which are depicted in the figures herein, a diversion point water delivery control system 100.

Referring now to FIGS. 1 through 5, a first embodiment of a diversion point water delivery control system 100 is shown. Generally speaking, the system may include a headgate assembly 105, 106, 107, 108 (a portion of which is 300 in FIG. 4), a headgate box 101, water level sensing means 109, 110, and a powered control unit 111.

Figure 4:
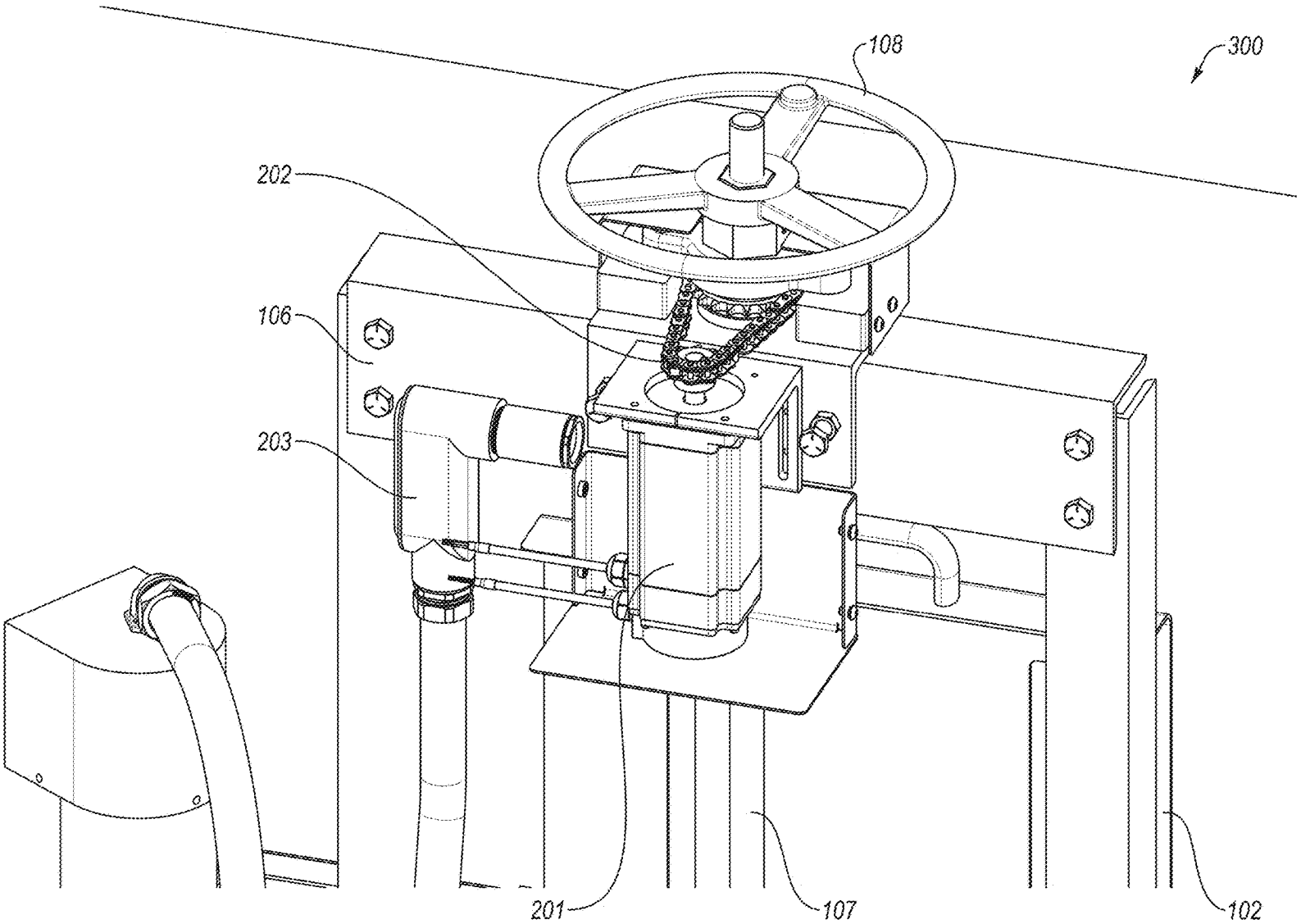
FIG. 4 is a perspective view of a portion of a headgate assembly portion in a first embodiment of a diversion point water delivery control system.

Headgate assembly may have a first gate 116 configured to interface with and/or open and close a first aperture 117 that connects to a first generally open channeled waterway 118, such as, for example, a ditch generally transverse to and/or branching from a canal 104. A powered actuator 201 (inside 105) may be connected to the first gate 116 through a linkage 107, 202, 108 positioned between the first gate 116 and the powered actuator 201. Powered actuator may be configured to move the position of the first gate 116 (for example, slidably, up and down) relative to the first aperture 117. Referring now to FIG. 4, headgate assembly 300 may also include a frame 106 and a manual means 108 for opening and closing the first gate 116.

Figure 5:
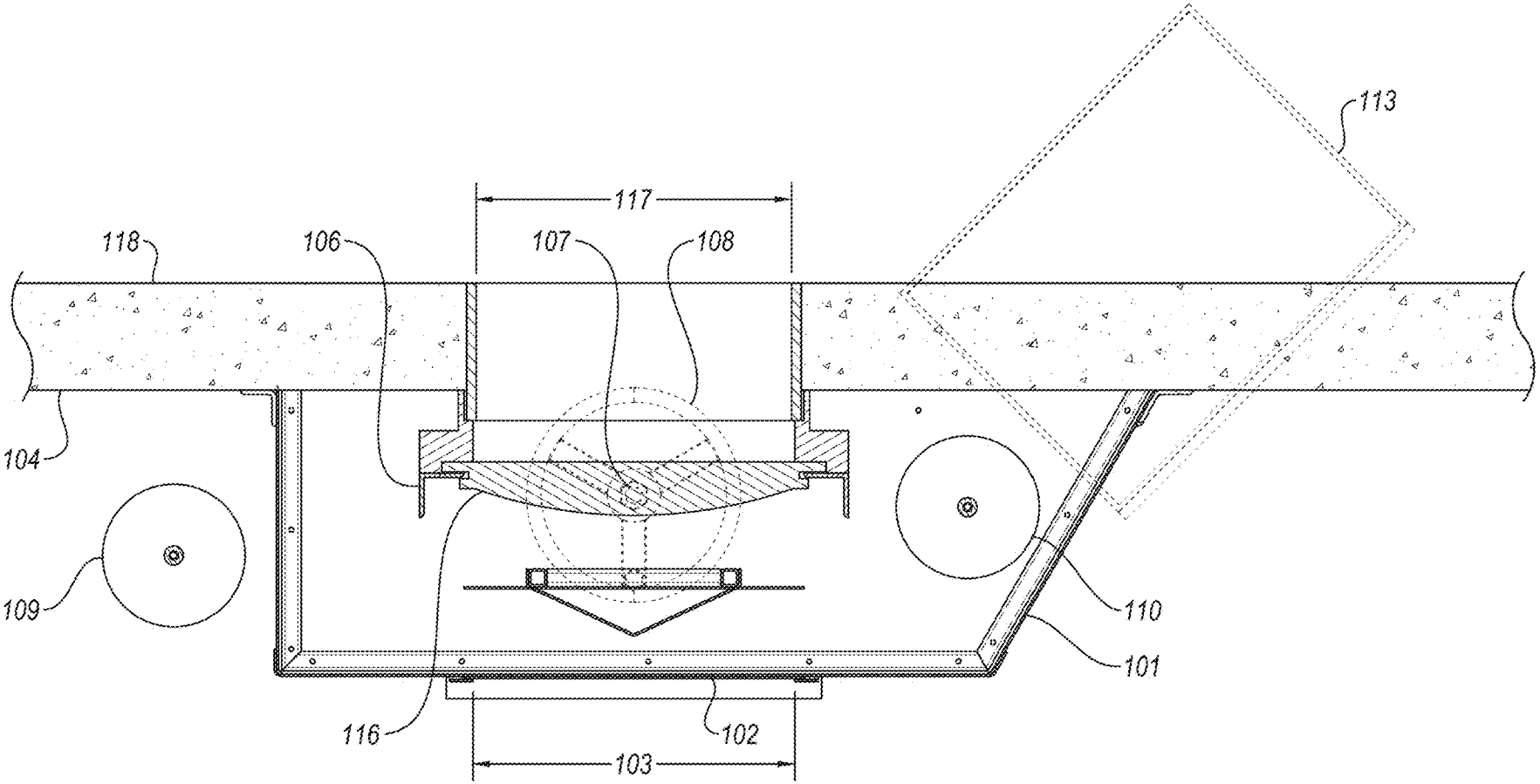
FIG. 5 is a top view of a first embodiment of a diversion point water delivery control system.
Figure 6:
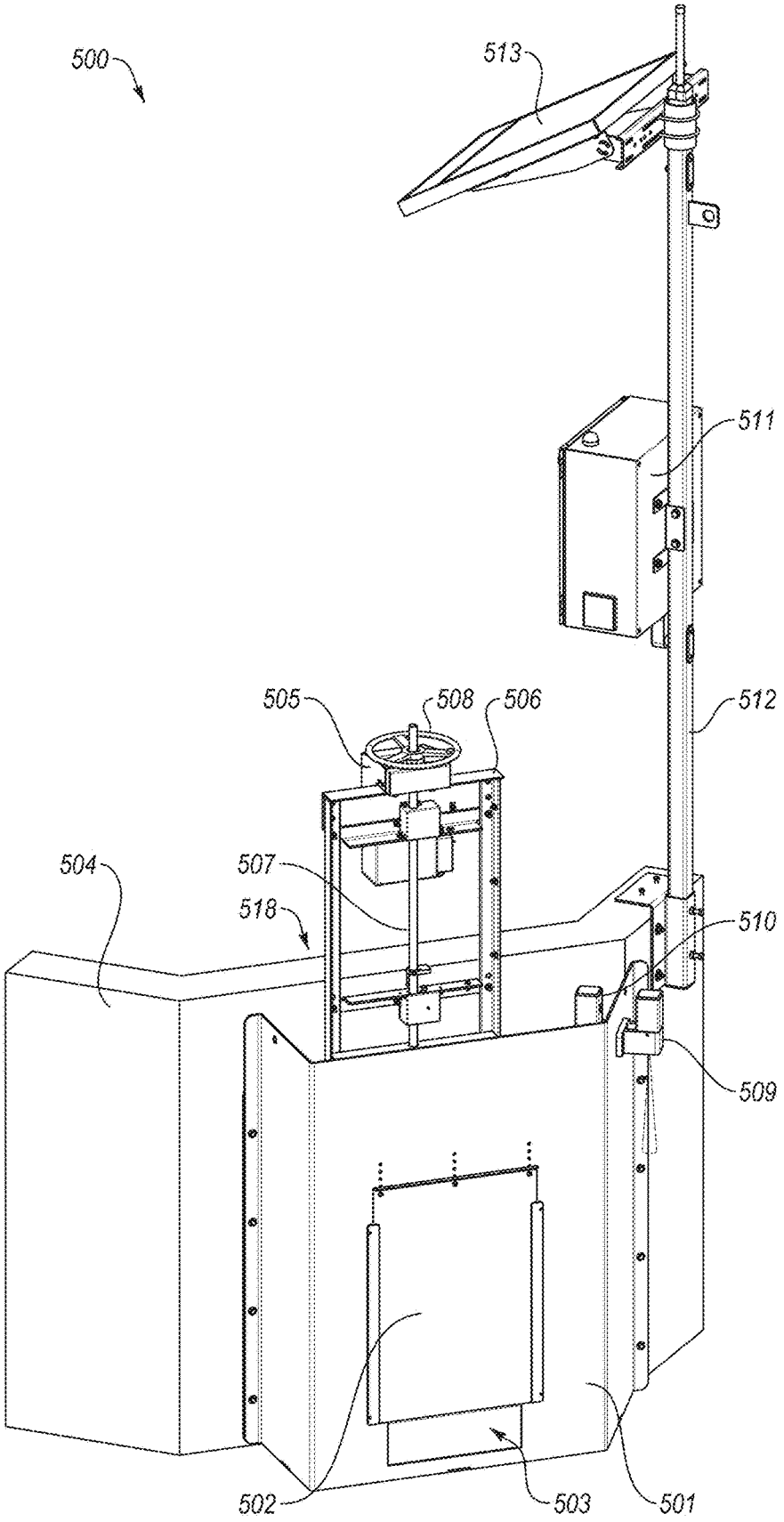
FIG. 6 is a first front perspective view of a second embodiment of a diversion point water delivery control system in a canal environment.
Figure 7:
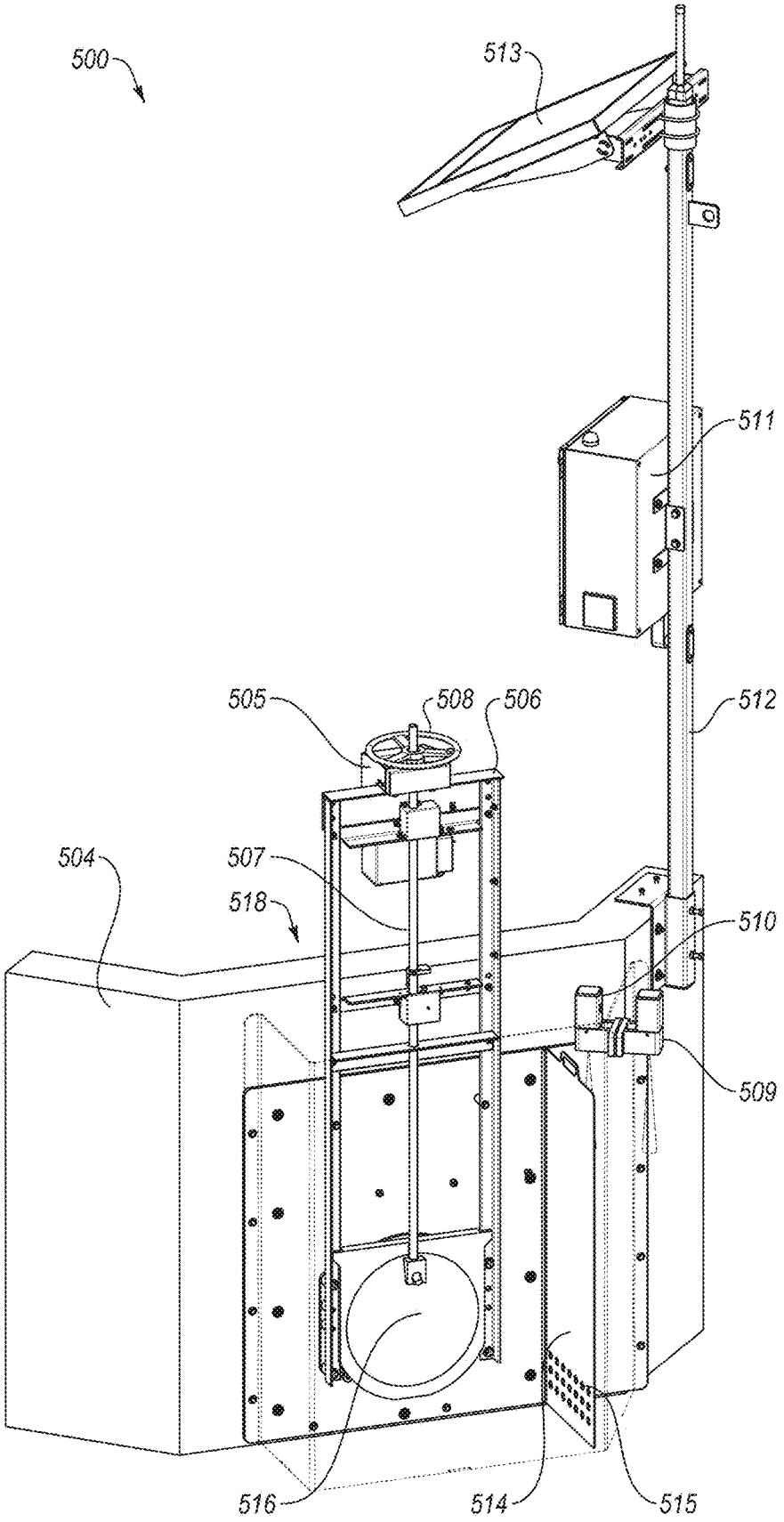
FIG. 7 is a second, front partial cross-section perspective view of a second embodiment of a diversion point water delivery control system in a canal environment.
Figure 8:
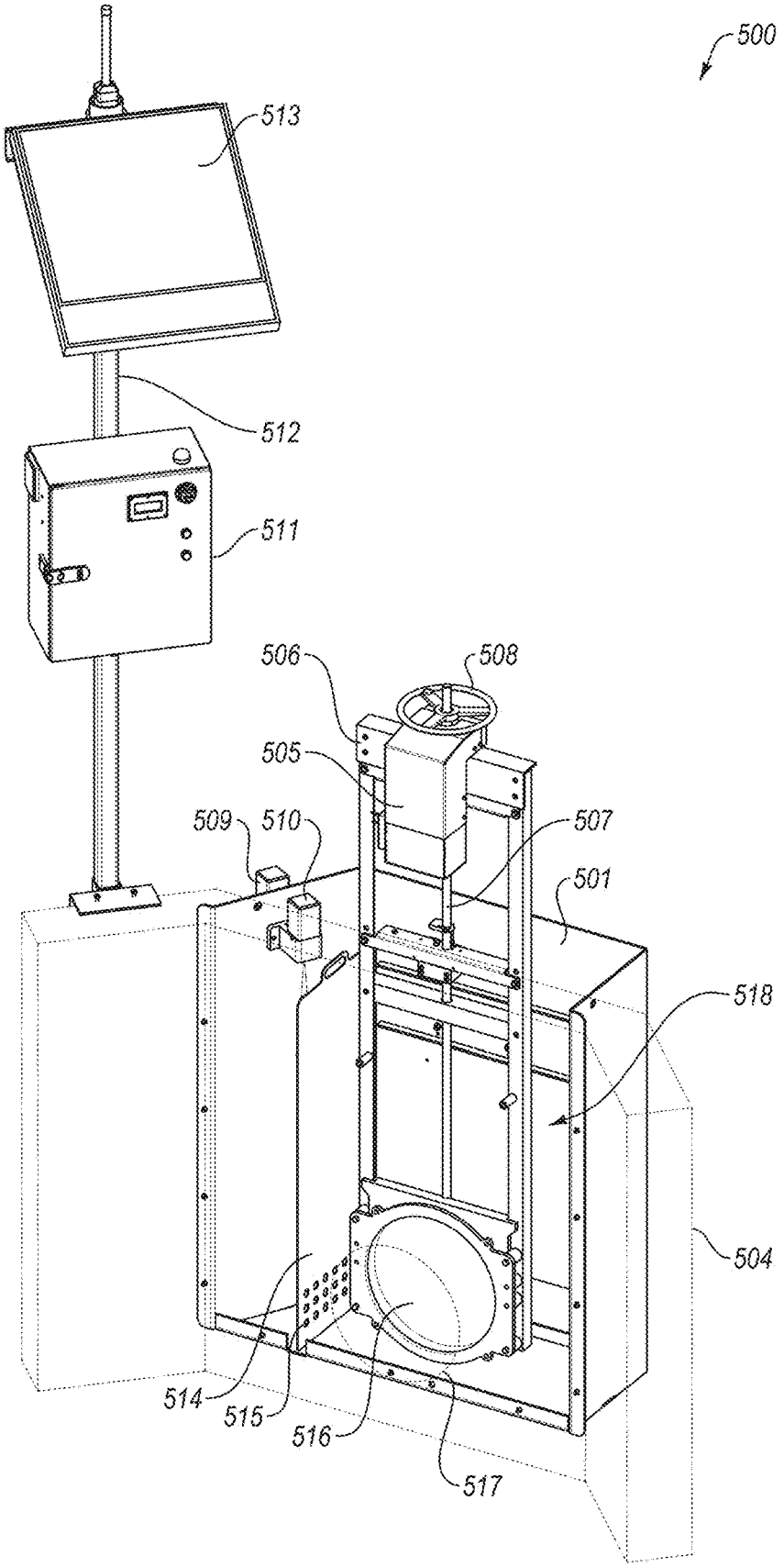
FIG. 8 is a back, partial cross-section perspective view of a second embodiment of a diversion point water delivery control system in a canal environment.

Headgate box 101 may be configured to generally surround the first gate 116 and first aperture 117 (except for an open top) and form a volume adjacent thereto (see, e.g., FIG. 5 inside box 101). Headgate box 101 may have a second gate 102 on one side configured to open and close (for example, slidably, up and down) a second aperture 103 located on the headgate box that interfaces and/or connects to a second generally open channeled water way (e.g., canal 104). Headgate box 101 may be configured to be attached to a canal side around a water diversion point. In the illustrated embodiment, headgate box 101 has three sides, a front, first side, and second side and second gate 102 and aperture 103 disposed on the front side of the headgate box 101. The headgate box 101 is configured to isolate the point of diversion and/or headgate from the canal 104 and to control the water flow to the point of diversion, headgate, and/or first aperture 117. The dimensions and/or size of the second aperture 103 are set at a known/fixed size. Second gate 102 is positioned up and/or down to force a difference in water elevation between water in the adjacent canal and water level inside the headgate box 101, in combination with the components described in more detail below. With a given size of aperture 103 water flow X therethrough may be calculated.

More specifically, the equation for computing the discharge of the standard submerged rectangular orifice is:

$$Q = C_c C_{vf} C_{va} A \sqrt{2g(h_1 - h_2)} \quad (9\text{-}1b)$$

where:

Q=discharge ($ft^3/s$)

$C_c$=coefficient of contraction $C_{vf}$=coefficient of velocity caused by friction loss $C_{va}$=coefficient to account for exclusion of approach velocity head from the equation A=the area of the orifice ($ft^2$)

g=acceleration caused by gravity ($ft/s^2$)

$h_1$=upstream head (ft)

$h_2$=downstream head (ft)

The coefficient of contraction, $C_c$, accounts for the flow area reduction of the jet caused by the flow curving and springing from the orifice edges. The coefficient $C_{vf}$ accounts for the velocity distribution and friction loss. The product, $C_cC_{vf}$, is sometimes called the coefficient of discharge, $C_d$. The coefficient $C_{va}$ accounts for using the water head only and does not fully account for the velocity head of approach. This coefficient is near unity if all the requirements of section 4 are met. The effective discharge coefficient, $C_d$, is the product $C_cC_{vf}C_{va}$, which has been determined experimentally to be 0.61 for rectangular irrigation weirs. The coefficient of contraction has the most influence on the effective coefficient discharge. Because $C_c$ must approach unity as velocity approaches zero, its value will increase rapidly after reaching some low velocity. Thus, the equation should not be used for heads less than 0.2 ft even with very precise head measuring devices. The difference between upstream and downstream heads or water surface elevations is sometimes called the differential head, and equation 9-1a can be rewritten as:

$$Q = C_d A \sqrt{2g\Delta h} \quad (9\text{-}1b)$$

where:

$\Delta h = h_1 - h_2$, differential head $C_d$=0.61, as determined experimentally.

The discharge, when velocity of approach is negligible, may be computed using equation 9-1b. The system is then set to deliver water flow X through the diversion point from one generally open channeled waterway to another generally open channeled waterway.

Figure 11:
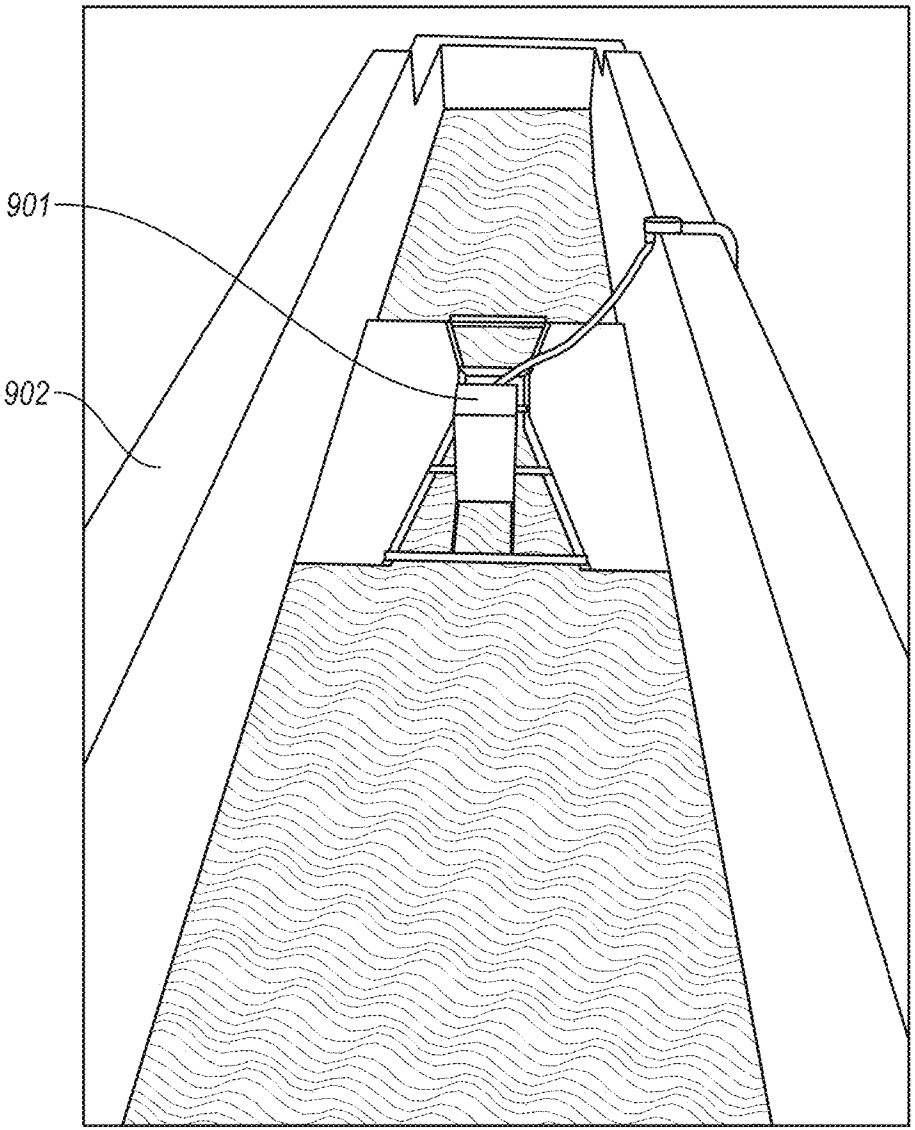
FIG. 11 is a downstream flume and float sensor for one embodiment of a diversion point water delivery control system.

Water level sensing means may include a first sensor 109 located outside the headgate box 101 (on, e.g., the canal-side 104); and a second sensor 110 located inside the headgate box 101 (on, e.g., the diversion point side 118). First 109 and second 110 sensors may be ultrasonic float sensors such as Turck LUS211-130-51-LI2UPN8-H1141 sensors. However, any suitable sensor for the functions described herein may be employed without departing from the purposes or scope of the invention, such as, for example, laser sensors, radar sensors and/or any sensor that measures distance. The first sensor 109 is configured to provide information such as the current water elevation in the canal (or second generally open channeled waterway) to the control unit 111 described below. The second sensor 110 provides information such as the water elevation inside the headgate box 101 to the control unit 111. Referring briefly to FIG. 11, optionally, the system 100 may include one or more additional downstream sensors 901 in communication with the control unit 111 and configured to confirm and/or check a target flow rate and/or to enable a separate means of control for the system.

Referring now to FIGS. 6 through 9, a second embodiment of a diversion point water delivery control system 500 is shown. As with the prior embodiment, this system may include a headgate assembly 505, 506, 507, 508, a headgate box 501, water level sensing means 509, 510, and a powered control unit 511.

Similar to the first embodiment, headgate assembly may have a first gate 516 configured to interface with and/or open and close a first aperture 517 that connects to a first generally open channeled waterway 518. A powered actuator (inside 505) may be connected to the first gate 516 through a linkage (e.g., 507, 508) between the first gate 516 and the powered actuator and be configured to move the position of the first gate 516 relative to the first aperture 517.

Figure 9:
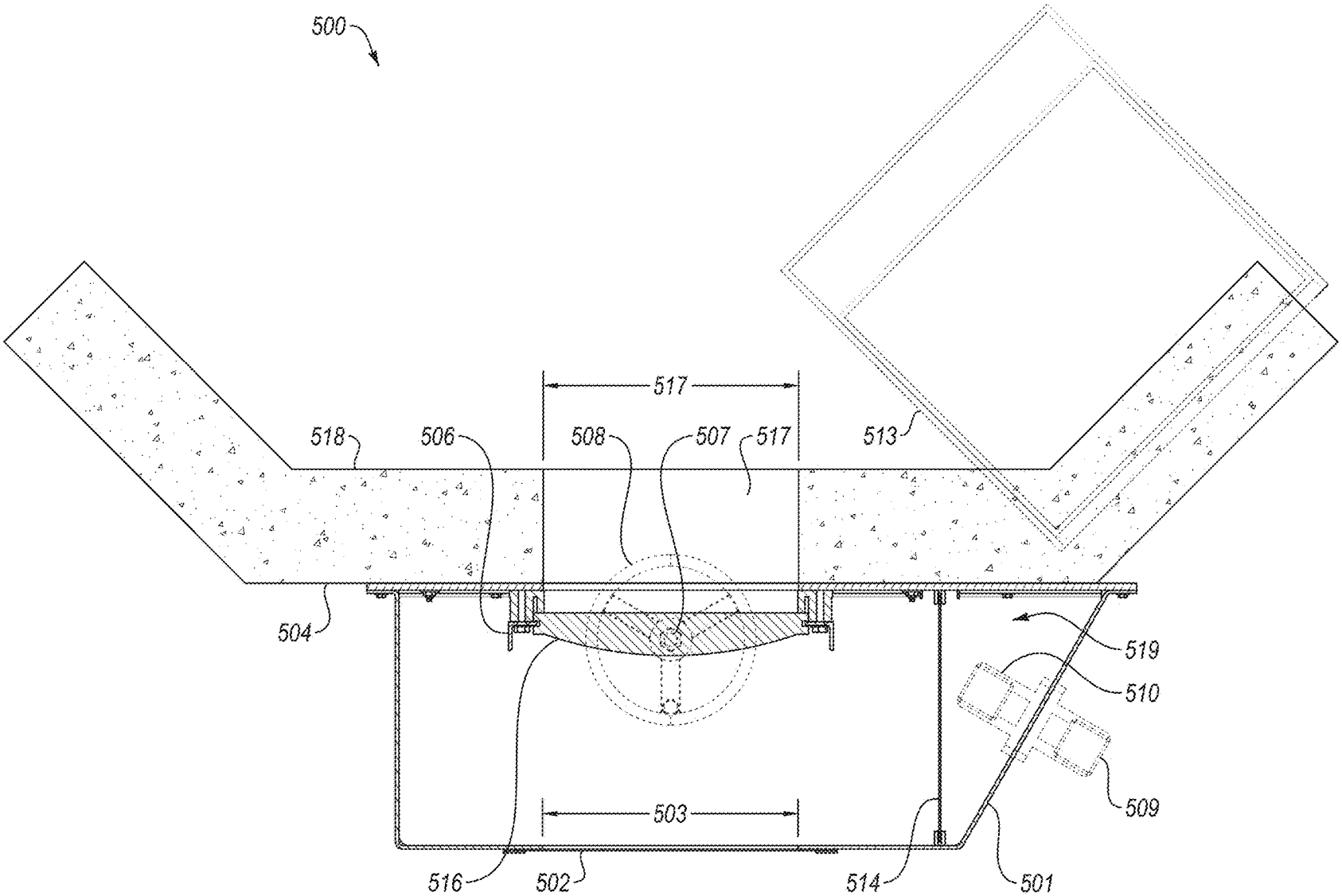
FIG. 9 is a top view of a second embodiment of a diversion point water delivery control system.

Again, headgate box 501 may be configured to generally surround the first gate 516 and first aperture 517 and form a volume adjacent thereto (see FIG. 9 inside respective box 501). Headgate box 501 may have a second gate 502 configured to open and close a second aperture 503 located on the headgate box 501 that interfaces and/or connects to a second generally open channeled water way (e.g., a canal 504). Headgate box 501 may be configured to be attached to a canal side around a water diversion point.

Various embodiments may include a sub-compartment 519 within the headgate box 501 that forms a stilling well. The sub-compartment 519 may be formed in part by one or more sides of the headgate box 501 and a sliding (up and down) third gate 514 that walls off a portion of the volume within the headgate box 501. The third gate 514 may be generally solid in its upper portions, with apertures 515 in lower portions configured to allow water from the main part of the headgate box 501 to flow into the sub-compartment 519 and/or stilling well. The stilling well is configured to provide a calm water surface within the headgate box 501 to ensure accurate sensor readings (from second sensor 510). In the illustrated embodiment, the first sensor 509 and second sensor 510 are radar sensors, such as, for example, Turck DR15S-M30E-IOL8X2-H1141.

In the illustrated embodiment, the headgate box and headgate assembly are preconfigured to be installed at a water diversion point together as a single, connected unit. This construction is intended to allow for case of shipping and installation at a water diversion point by a user.

Figure 10:
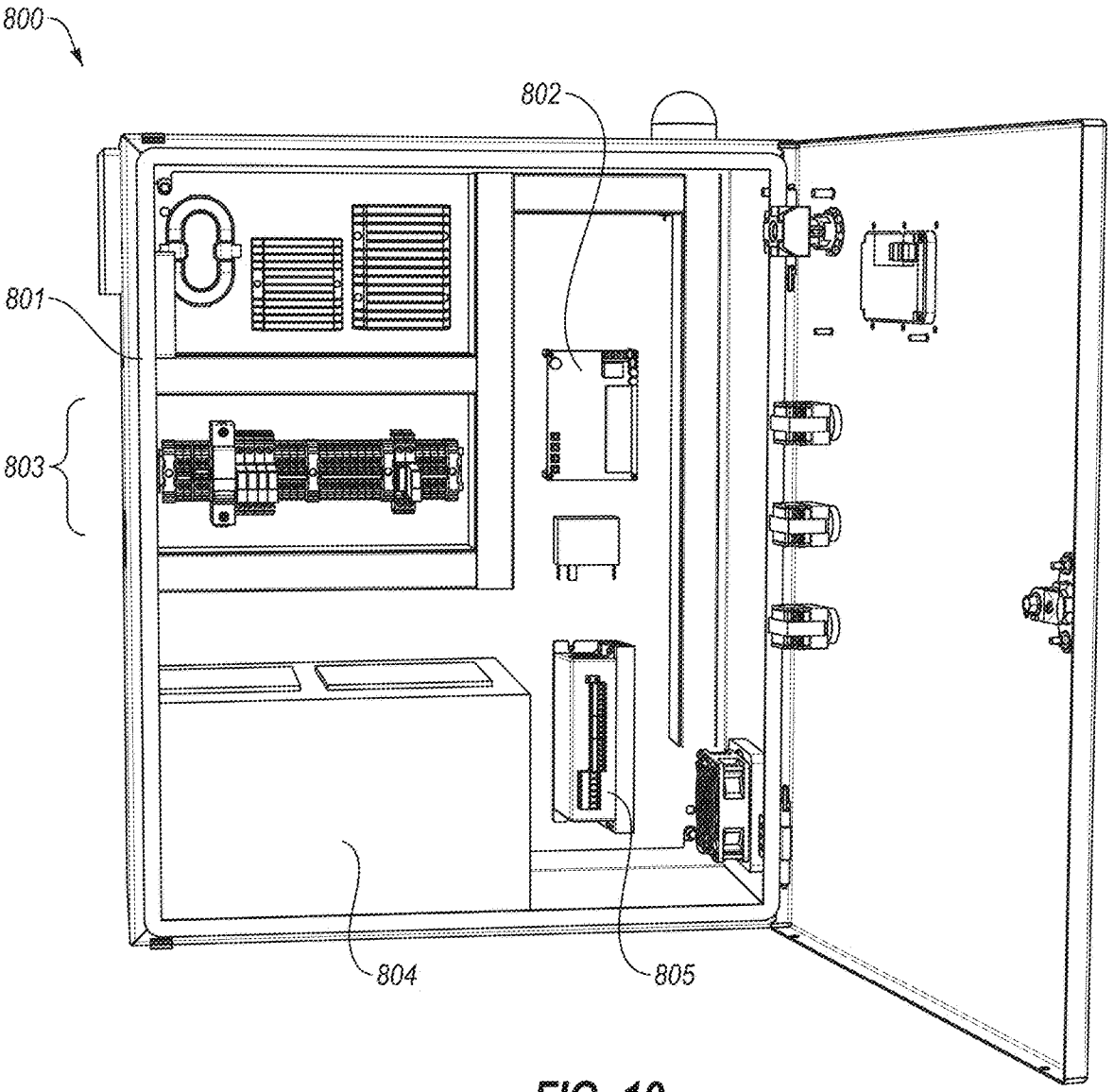
FIG. 10 is a control unit in one embodiment of a diversion point water delivery control system.

Powered control unit 111, 511 may be in communication with the first and second sensors, and headgate assembly (e.g., 105), and have receiving and transmission means (e.g., transceiver, antennae, etc.) 112. In various embodiments, the system may also include a solar panel 113, 513 for providing power to the control unit and/or system 100. Referring now to FIG. 10, the control unit 800 may have a housing 801 with a printed circuit board (PCB) 802, computer with processor, relays (e.g., 803), battery 804 (and/or means for wiring to another local power source), motor drive (for the headgate assembly actuator) 805, and means for wirelessly transmitting data and/or instructions to and from the control unit 800 through the transceiver and any number of devices and/or technologies including the internet and/or one or more of a computer, mobile devices, and the like. In one example, control unit 800 may include long range Bluetooth such as a LoRa node and/or one or more base stations that act as a gateway to the internet and/or mobile devices. In other embodiments, the system may include a base station that is separate from the control unit 800 to amplify, receive, and/or transmit information to and from the control unit 800 from other locations. Many different means of achieving wired and/or wireless transmission of data and/or instructions to and from the control unit may be suitable and known to one skilled in the art.

Figure 12:
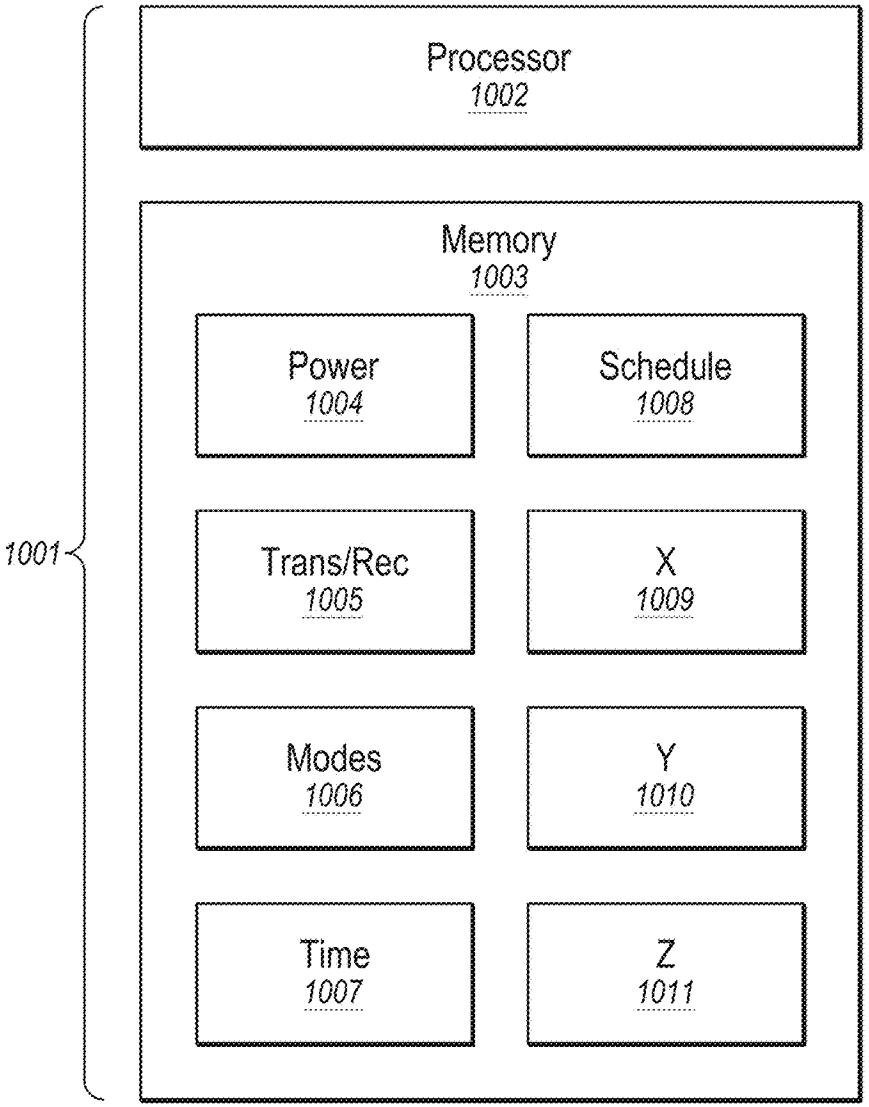
FIG. 12 is a block diagram of a processor with memory in one embodiment of a diversion point water delivery control system.

Referring now to FIG. 12, in addition to means for transmitting data and/or instructions, the control unit 800 and/or system 100, 500 may include a computer 1001 with processor 1002 and memory 1003 with one or more modules to operate the control unit 800 and various functions and components of the headgate assembly 300 and sensors 109, 110, 509, 510, 901. For example, memory 1003 may include one or more modules for: (1) managing the power of the unit, including powering the unit on and/or off and managing battery and/or solar power 1004; (2) initiating, sending, or receiving information from the transceiver/receiver means 1005; (3) operating the system within predetermined modes, including modes for setting and achieving a target flow rate at a point of diversion by automatically opening and/or closing the first gate to a certain degree 1006; (4) timing of operations (e.g., durations of flow rates) 1007; (5) scheduled operations 1008 (e.g., initiation and/or cessation of flow rates); (6) for interface controls (1009); and any number of other operations (1010, 1011). In certain embodiments, the computer with processor may be a mobile device to remotely access the system.

Figure 13:
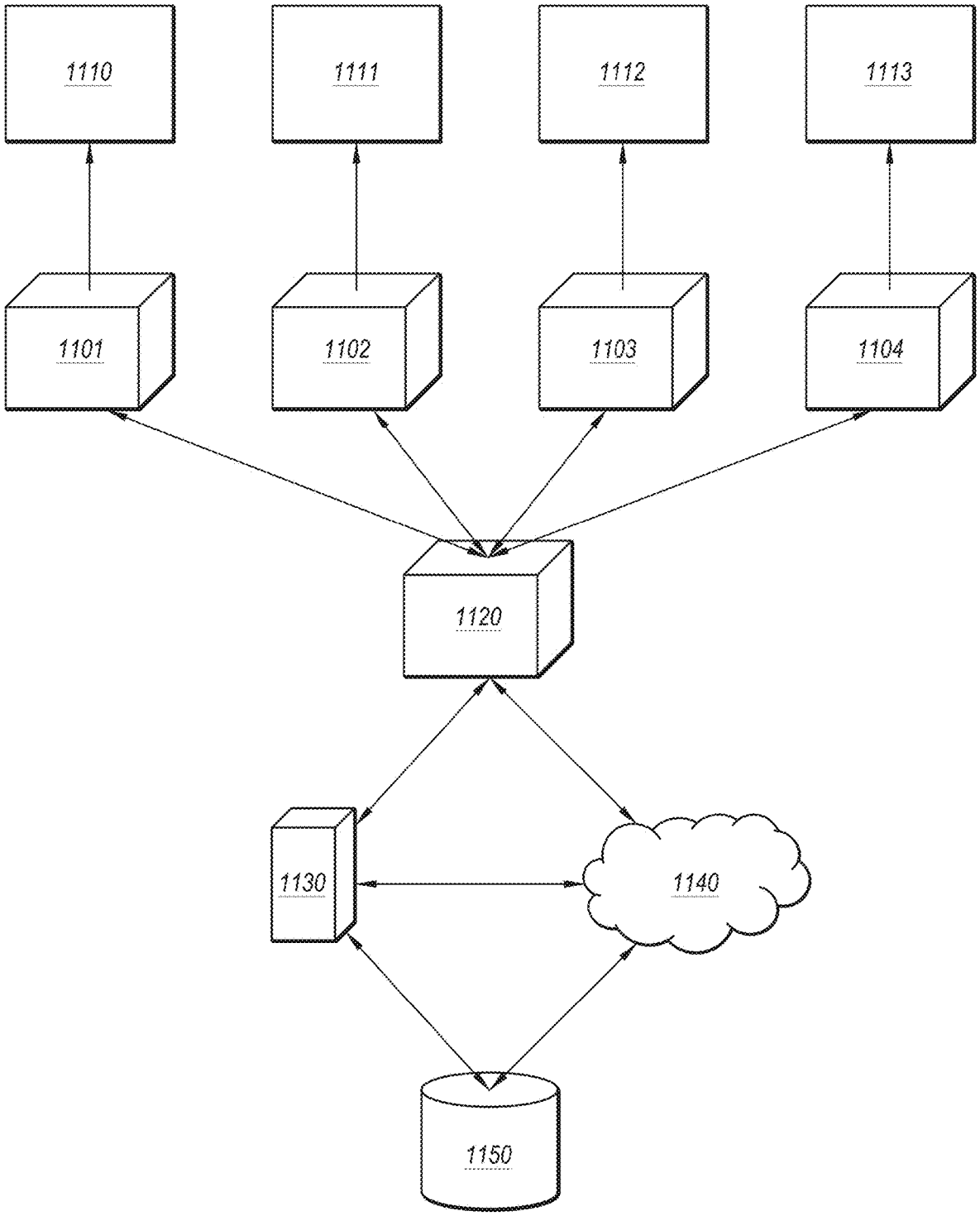
FIG. 13 is a block diagram showing a plurality of systems used in a scalable embodiment of the system.

Referring now to FIG. 13, use of system units scaled to a broader system is shown. Within the system, a plurality of systems 1101, 1102, 1103, 1104 may be deployed, each at a different respective diversion point (e.g., 1110, 1111, 1112, 1113), along a larger system such as a canal. Plurality of units may be in communication with a local network and/or base station 1120 for facilitating the transmission of data and/or instructions to and from each unit. Local network and/or base station 1120, in turn, may be in communication with one or more mobile devices 1130 and/or the internet 1140. The one or more mobile devices 1130 and/or internet 1140 may be in communication with a database 1150 containing information (e.g., flow rate, water elevation, flow status, etc.) from system units and/or particular diversion points.

Figure 14:
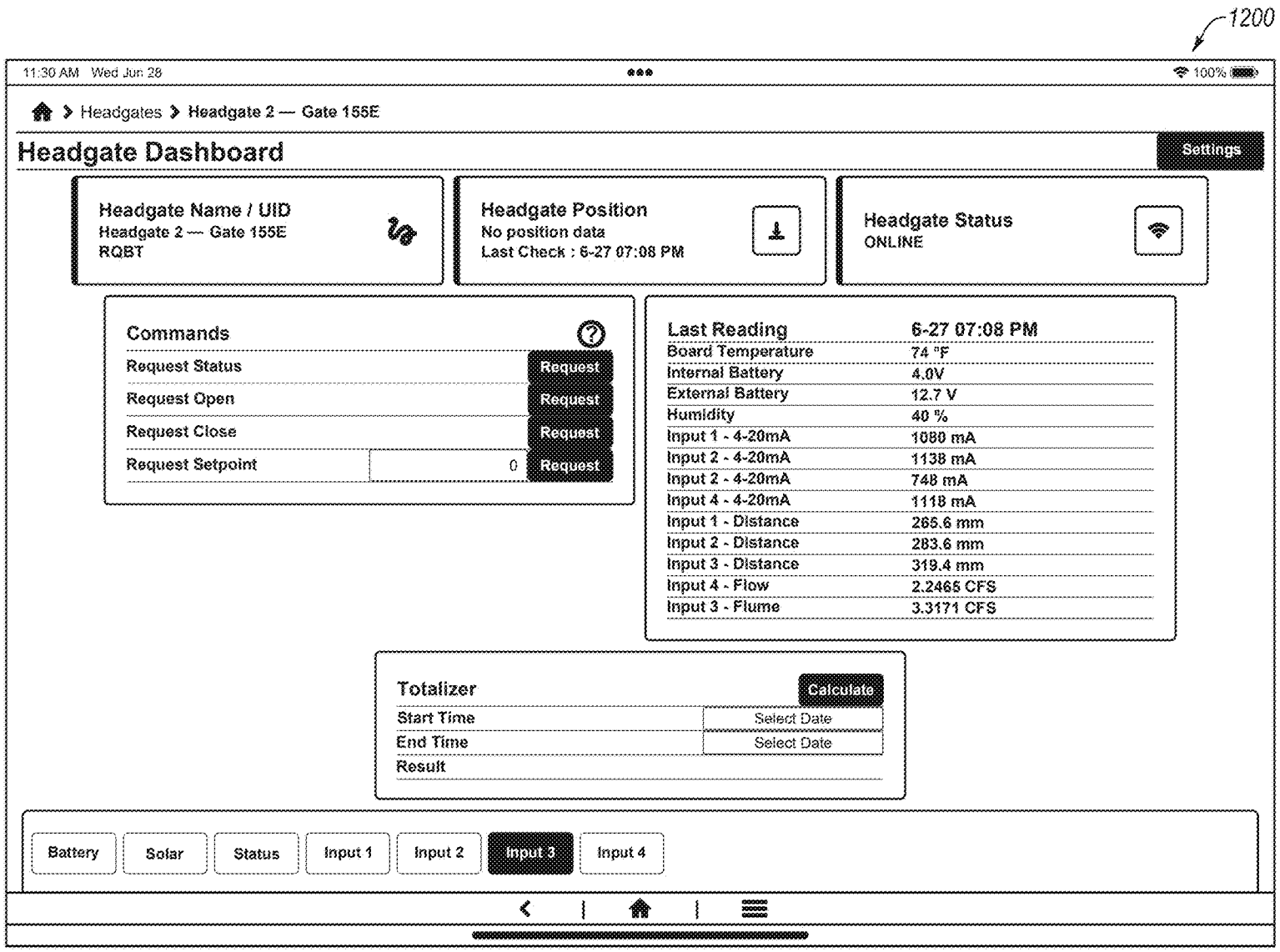
FIG. 14 is a first user interface in one embodiment of a diversion point water delivery control system.

Referring now to FIG. 14, exemplary user interfaces, controls, and modes in a mobile application implementing one embodiment of the system are shown. Status indicators may signal the functional status of the system (including whether it is live and communicating). "Request" commands may include "Open" for opening the headgate to a target flowrate, such as, for example, a number entered as a "Setpoint." The "Close" command causes the headgate to close. Any number of different commands, modes, controls, or features may be used to accomplish the purpose of the invention as set forth above.

So, configured, the invention includes a diversion point water delivery control system configured to deliver a target flowrate downstream despite variable upstream water levels. The problems created by high flow variability in primary channels, including overdelivery, theft, flooding, and the like, as well as lack of meaningful flow and diversion data to optimize function and efficiency, are solved.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

We claim:

1. A diversion point water delivery control system comprising:

a headgate assembly with a first gate configured to interface a first generally open channeled waterway;

a powered actuator connected to and configured to move the first gate;

a headgate box with a second gate configured to interface a second generally open channeled waterway;

sensing means adjacent to the headgate box for measuring water levels adjacent to the headgate box, the sensing means comprised of a first sensor attached to a first side of the headgate box and configured to measure a first water level outside the headgate box; and a second sensor attached to a second side of the headgate box opposite the first sensor and configured to measure a second water level inside the headgate box; and a powered control unit connected to the powered actuator and sensing means, the powered control unit having a computer with memory with one or more modules to operate the system.

2. The diversion point water delivery control system of claim 1, the one or more modules including a module with instructions to automatically adjust the position of the first gate to maintain a predetermined water flow to the first generally open channeled waterway from the second generally open channeled waterway despite water level fluctuation in the second generally open channeled waterway.

3. The diversion point water delivery control system of claim 1, the powered control unit further having a transceiver for receiving and sending one or more of user instructions, water level data, water flow data, and system status to an off-site location that is in communication with the system.

4. The diversion point water delivery control system of claim 3, wherein the off-site location is one or more of a base station for amplifying transmissions to and from the system, network, cloud, mobile phone, laptop, and desktop computer.

5. The diversion point water delivery control system of claim 1, further comprising a sub-compartment within the headgate box that forms a stilling well.

6. The diversion point water delivery control system of claim 5, wherein the first and second sensors are radar sensors.

7. The diversion point water delivery control system of claim 1, wherein the headgate box and headgate assembly are a single unit for user installation at a water diversion point.

8. A diversion point water delivery control system comprising:

a headgate assembly with a first gate configured to open and close a first aperture configured to connect to a first generally open channeled waterway a powered actuator connected to the first gate and configured to move the position of the first gate relative to the first aperture; and a linkage connecting and between the first gate and the powered actuator a headgate box configured to generally surround the first gate and first aperture and form a volume adjacent thereto, the headgate box having a second gate configured to open and close a second aperture located on the headgate box that is configured to connect to a second generally open channeled waterway;

a first sensor attached to a first side of the headgate box and configured to measure a first water level outside the headgate box;

a second sensor attached to a second side of the headgate box opposite the first sensor and configured to measure a second water level inside the headgate box; and a powered control unit connected to the powered actuator and the first and second sensors, the powered control unit having a computer and memory with modules for controlling the powered actuator, first sensor and second sensor; and a transceiver for receiving and sending one or more of user instructions, water level data, water flow data, and system status to an off-site location that is in communication with the system.

9. The diversion point water delivery control system of claim 8, wherein the off-site location is one or more of a base station for amplifying transmissions to and from the system, network, cloud, mobile phone, laptop, and desktop computer.

10. The diversion point water delivery control system of claim 8, the powered control unit having a computer and memory with modules, one module of which has instructions to automatically adjust the position of the first gate to maintain a predetermined water flow through the first aperture to the first generally open channeled waterway from the second generally open channeled waterway despite water level fluctuation in the second generally open channeled waterway.

11. The diversion point water delivery control system of claim 8, wherein the modules of the powered control unit having a computer and memory are for one or more of:

managing the power of the powered control unit;

initiating, sending, and receiving information from the transceiver;

system operation, including setting and achieving a target flow rate at a point of diversion by positioning the first gate;

setting times of duration for one or more first gate positions; and scheduling the time of one or more first gate positions.

12. The diversion point water deliver control system of claim 8, further comprising a sub-compartment within the headgate box that forms a stilling well.

13. The diversion point water delivery control system of claim 12, wherein the first and second sensors are radar sensors.

14. The diversion point water delivery control system of claim 8, wherein the headgate box and headgate assembly are a single unit for user installation at a water diversion point.

15. A diversion point water delivery control system comprising:

a headgate assembly with a first gate configured to open and close a first aperture configured to connect to a first generally open channeled waterway a powered actuator connected to the first gate and configured to move the position of the first gate relative to the first aperture; and a linkage connecting and between the first gate and the powered actuator a headgate box configured to generally surround the first gate and first aperture and form a volume adjacent thereto, the headgate box having a second gate configured to open and close a second aperture located on the headgate box that is configured to connect to a second generally open channeled waterway;

a first sensor attached to a side of the headgate box and configured to measure a first water level outside the headgate box;

a second sensor attached to a side of the headgate box opposite the first sensor and configured to measure a second water level inside the headgate box; and a powered control unit connected to the powered actuator and the first and second sensors, the powered control unit having a computer and memory with modules for one or more of managing the power of the powered control unit;

initiating, sending, and receiving information from the transceiver;

system operation, including setting and achieving a target flow rate at a point of diversion by positioning the first gate;

setting times of duration for one or more first gate positions; and scheduling the time of one or more first gate positions;

a transceiver for receiving and sending one or more of user instructions, water level data, water flow data, and system status to one or more of a base station for amplifying transmissions to and from the system, network, cloud, mobile phone, laptop, and desktop computer.

16. The diversion point water delivery control system of claim 15, further comprising a sub-compartment within the headgate box that forms a stilling well.

17. The diversion point water delivery control system of claim 16, wherein the first and second sensors are radar sensors.

18. The diversion point water delivery control system of claim 15, wherein the headgate box and headgate assembly are a single unit for user installation at a water diversion point.

* * * * *